US006770003B2

(12) United States Patent
Loverock et al.

(10) Patent No.: US 6,770,003 B2
(45) Date of Patent: Aug. 3, 2004

(54) HOCKEY NET PROTECTOR

(75) Inventors: David Loverock, Aurora (CA); Deborah Wilcock, Aurora (CA)

(73) Assignee: Jet Ice Limited, Newmarket (CA)

( * ) Notice: Subject to any disclaimer, the term of this patent is extended or adjusted under 35 U.S.C. 154(b) by 0 days.

(21) Appl. No.: 10/058,774

(22) Filed: Jan. 30, 2002

(65) Prior Publication Data

US 2003/0144092 A1 Jul. 31, 2003

(51) Int. Cl.[7] ..... A63B 63/00
(52) U.S. Cl. ..... 473/478; 112/416; 112/417
(58) Field of Search ..... 473/478, 197, 473/462, 456, 494, FOR 132; 112/416, 417, 418

(56) References Cited

U.S. PATENT DOCUMENTS 1,291,100 A * 1/1919 Overmyer ..... 296/138

FOREIGN PATENT DOCUMENTS

| | | |
|---|---|---|
| CA | 1202650 | 4/1986 |
| CA | 1216315 | 1/1987 |
| CA | 2277694 | 1/2000 |

* cited by examiner

*Primary Examiner*—Stephen P. Garbe
*Assistant Examiner*—M. Chambers
(74) *Attorney, Agent, or Firm*—Bereskin & Parr

(57) ABSTRACT

In one aspect, the invention is directed to a hockey net protector including an outer layer and an inner layer. The outer layer includes an elongate band of tear resistant and puncture resistant material. The outer layer has an inside face, an upper edge and a lower edge. The inner layer has a plurality of grommets mounted thereon for connecting the protector to a hockey net. The inner layer is attached to the inside face of the outer layer, so that the grommets are covered by the outer layer.

8 Claims, 7 Drawing Sheets

HOCKEY NET PROTECTOR

FIELD OF THE INVENTION

The invention relates to hockey net protectors.

BACKGROUND OF THE INVENTION

Hockey net protectors are used to protect the mesh on a hockey net from the blades of players' skates during play behind the net. Typically, a hockey net protector is an elongated band from a tear resistant and puncture resistant material, having an upper row and a lower row of grommets along the length of the band. The grommets permit the band to be attached to the hockey net using a suitable cord. During play, however, hockey players can get their skates tangled in the cord. Furthermore, the protector does little to protect the lower portion of the frame from metal-to-metal contact with players' skates, which can potentially damage both the frame and the skates. Furthermore, because of the generally poor fit between the protector and the net, there is a risk of the hockey puck front becoming lodged between the protector and the net during play.

There is a need for improved hockey net protectors, that protect against getting tangled with players' skates and that provide improved protection of the lower rear bar, and that inhibit the puck from being lodged between the protector and the net during play.

SUMMARY OF THE INVENTION

In a first aspect, the invention is directed to a hockey net protector, comprising an outer layer and an inner layer. The outer layer includes an elongate band of tear resistant and puncture resistant material. The band has an inside face, an upper edge and a lower edge. The inner layer has a plurality of grommets mounted thereon for connecting the protector to a hockey net. The inner layer being attached to the inside face of the outer layer, so that the grommets are hidden by the outer layer.

In a second aspect, the invention is directed to a hockey net protector, comprising an elongate band of tear-resistant and puncture-resistant material. The band includes a planer central portion for mating with a generally planar central rear portion of a hockey net. The band also includes an outer portion on each side of said central portion. Each outer portion has a generally coned shape, for mating with a generally conical side portion on the hockey net. The band also has a plurality of grommets mounted thereon for connecting the protector to the hockey net.

DESCRIPTION OF THE DRAWINGS

For a better understanding of the present invention and to show more clearly how it may be carried into effect, reference will now be made by way of example to the accompanying drawings, showing a hockey net and a hockey net protector in accordance with a preferred embodiment of the present Invention In which.

DESCRIPTION OF THE PREFERRED EMBODIMENT

Figure 1A:
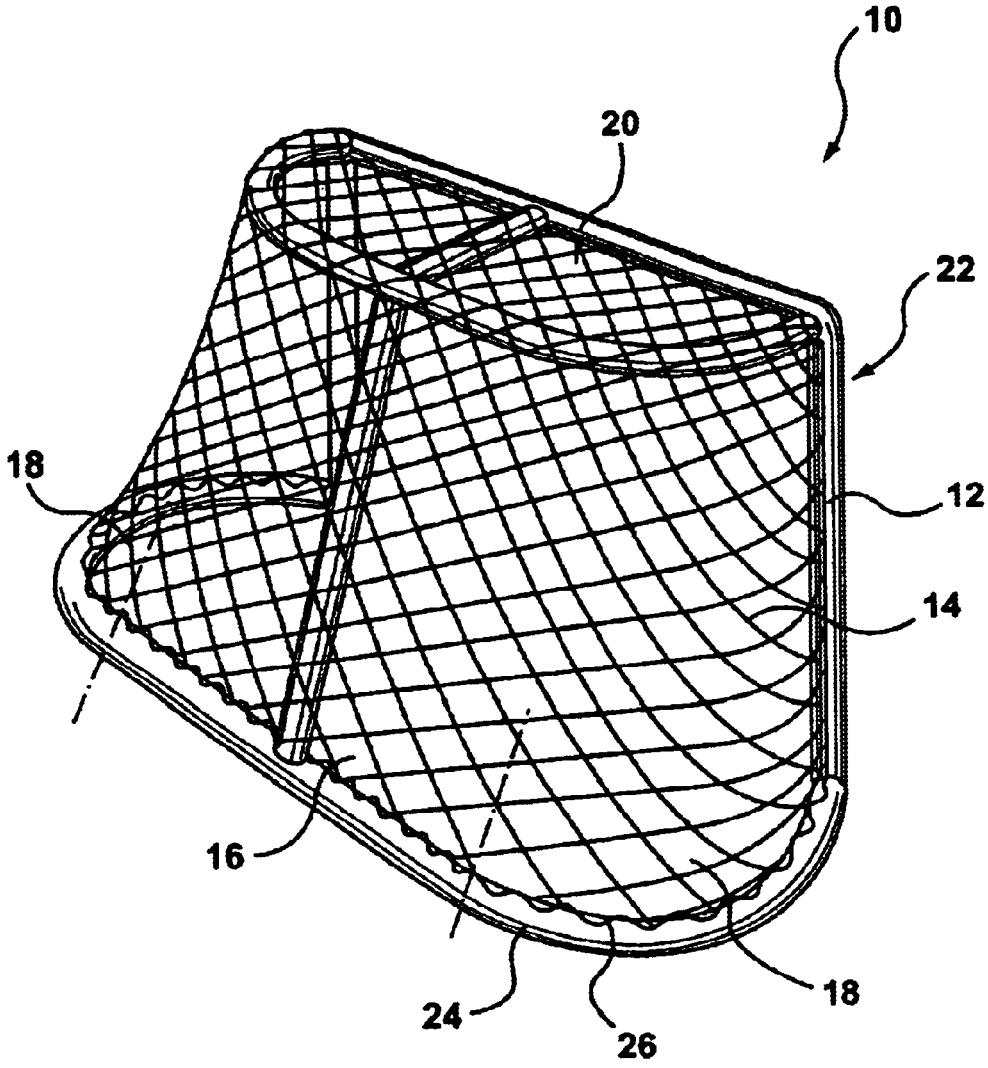
FIG. 1*a* is a perspective view of a hockey net.
Figure 1B:
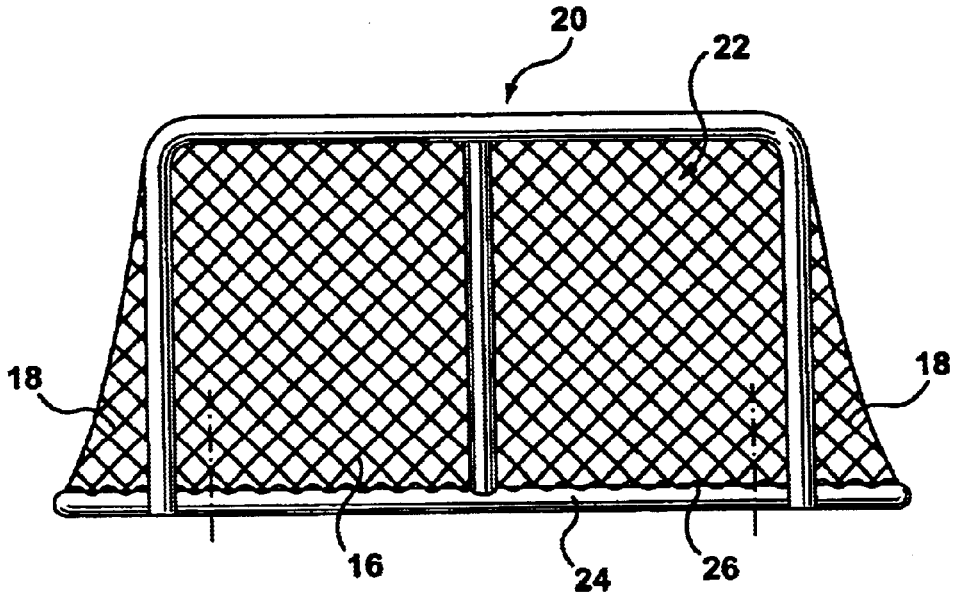
FIG. 1*b* is a front elevation view of the hockey net shown in FIG. 1*a;*
Figure 1C:
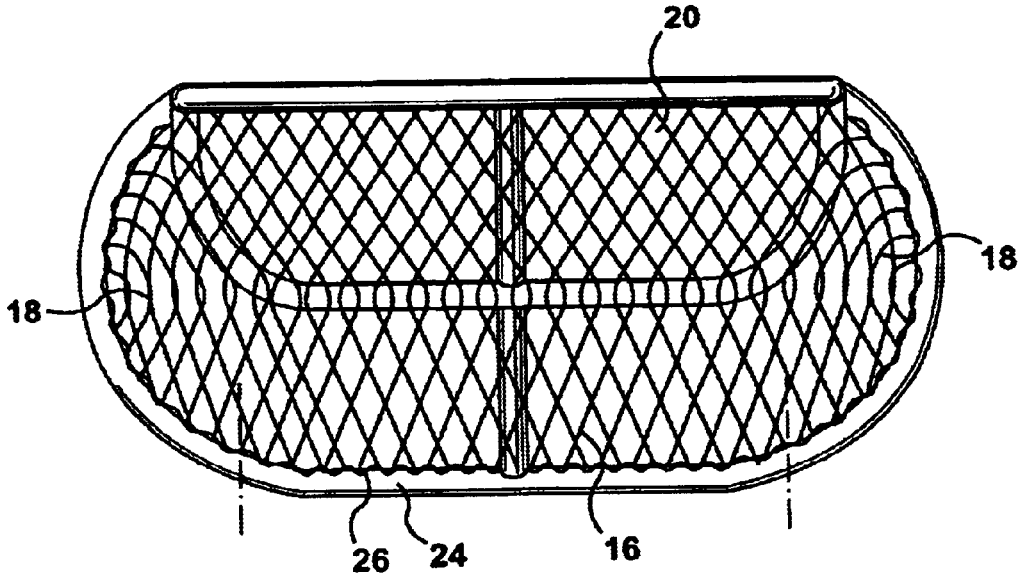
FIG. 1*c* is a top plan view of the hockey net shown in FIG. 1*a;*

Reference is made to FIGS. 1*a*, 1*b* and 1*c*, which show a hockey net 10. Hockey net 10 includes a frame 12 and a mesh 14. The frame 12 and mesh 14 define a central rear portion 16, two side portions 18, a top portion 20, and a front opening 22. The central rear portion 16 is generally planar, and sloped. The side portions 18 are generally conical and are tangentially associated with the rear portion 16. The top portion 20 is generally planar and horizontal.

The frame 12 includes a lower rear bar 24, to which the lower edge of the mesh 14 is attached. Crimping 26 may be included an the upper surface of the lower rear bar 24, for the attachment of a hockey net protector.

Figure 2:
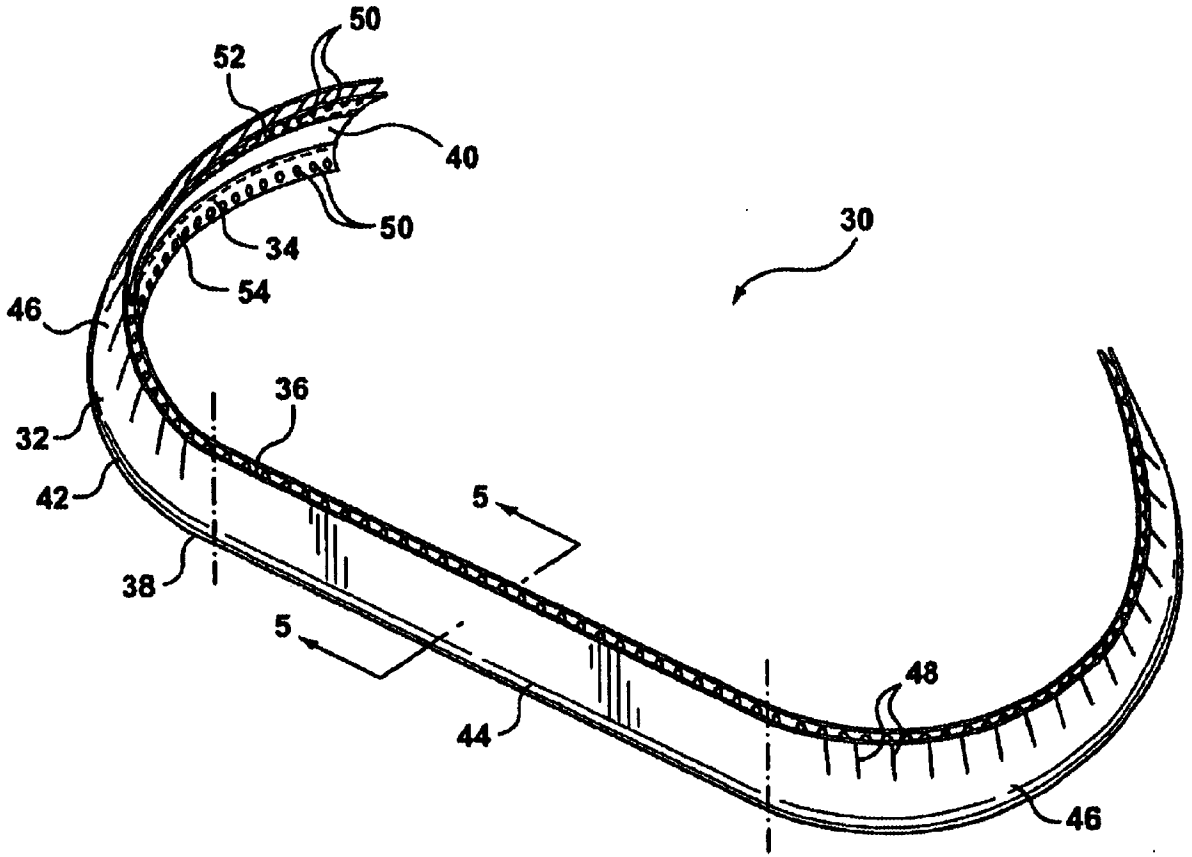
FIG. 2 is a perspective view of a hockey net protector in accordance with a first embodiment of the present invention.
Figure 3:
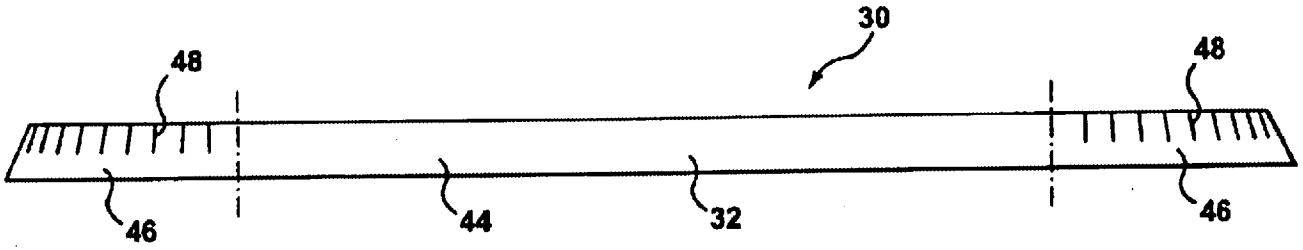
FIG. 3 is a side elevation view of the hockey net protector shown in FIG. 2.
Figure 5:
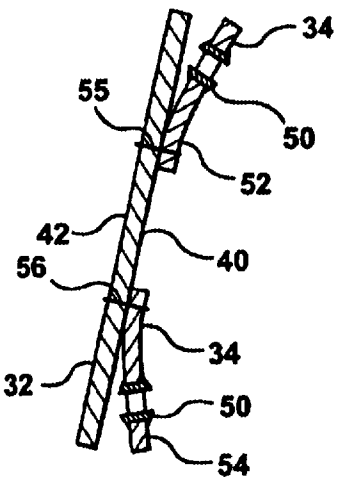
FIG. 5 is a view of the hockey net protector shown in FIG. 2, along section 5—5.
Figure 4:
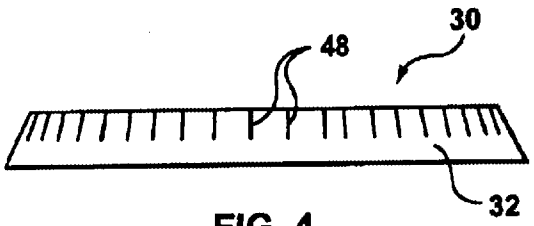
FIG. 4 is a front elevation view of the hockey net protector shown in FIG. 2.

Reference is made to FIG. 2, which shows a hockey net protector 30 in accordance with a first embodiment of the present invention. Hockey net protector 30 is for protecting the lower portion of the mesh of hockey net 10 from players' skates during play behind hockey net 10. Furthermore, hockey net protector 30 provides a barrier to prevent metal-to-metal contact between players' skates and the lower rear bar 24 of hockey net 10.

Hockey net protector 30 includes an outer layer 32 and an inner layer 34. The outer layer 32 is an elongate band of material that is puncture resistant and may be tear-resistant, such as, for example, ballistic nylon. The outer layer 32 has an upper edge 36, a lower edge 38, an inside face 40 and an outside face 42.

Outer layer 32 may have a central portion 44 that is generally planar for mating with the generally planar central rear portion 15 of hockey net 10. Central portion 44 may be generally the same length as the central rear portion of hockey net 10. Outer layer 32 may also include two outer portions 46 which are generally conical in shape, for mating with the generally conical side portions 18 of hockey net 10. Outer layer 32 may be generally the same length as the side portions 18 of hockey net 10.

Outer portions 40 may be made conical using any suitable technique. For example, outer portions 46 may include pleats 48. Pleats 48 extend transversely from the upper edge 36 part-way across the width of the outer layer 46. Pleats 48 cause the outer portions 46 to have a shorter length along the upper edge 36 than on the lower edge 38, which in turn, causes a conical curl in outer portions 46.

Referring to FIGS. 5, 7, 8 and 9, the inner layer 34 is attached to the inside face 40 of the outer layer 32. The inner layer 34 has a plurality of grommets 50 therethrough, which are hidden by the outer layer 32. For example, the inner layer 34 may comprise an upper grommet band 52 and a lower grommet band 54. The upper grommet band 52 may be made from a material such as, for example, a weaved nylon webbing. The upper grommet band 52 has a plurality of grommets 50 therethrough. The grommets 50 may be distributed along the length of the upper grommet band 52. The center-to-center spacing between adjacent grommets 50 may be sufficiently small so that a pocket cannot be formed between them that a puck can fit into inadvertently during play. For example, the center-to-center spacing between adjacent grommets 50 may be less than the diameter of a standard hockey puck. The center-to-center spacing may be, for example, 2".

The upper grommet band 52 may be positioned on outer layer 32 adjacent to the upper edge 36. The upper grommet band 52 may be attached to the outer layer 32 by any suitable means, such as by being sewn on to outer layer 32. Alternatively, the upper grommet band 52 may, for example, be riveted, welded (eg. sonic welded) or glued to the outer layer 32. The line of attachment of the upper grommet band 52 to the outer layer 32 is shown at 55. The line of attachment 55 may be spaced from the upper edge 36 of the outer layer 32 by any suitable amount, and may be on the lower edge of the upper grommet band 52, so that the upper grommet band 52 extends upwardly therefrom and has a free upper edge. Alternatively, the line of attachment 55 may be along the uppermost edges of both the upper grommet band 52 and the outer layer 32, so that the upper grommet band 52 extends downwardly therefrom (see FIGS. 7 and 8). As another alternative, the upper grommet band 52 may be attached to the outer layer 32 along two lines of attachment, one line being on each side of the grommets 50.

In a similar fashion to the upper grommet band 52, The upper grommet band 62 may be made from a material such as, for example, a weaved nylon webbing, and has a plurality of grommets 50 therethrough. The lower grommet band 54 may be positioned on the outer layer 32 so that the lower edge of the lower grommet band 54 is adjacent to the lower edge 38 of the outer layer 32.

Figure 6:
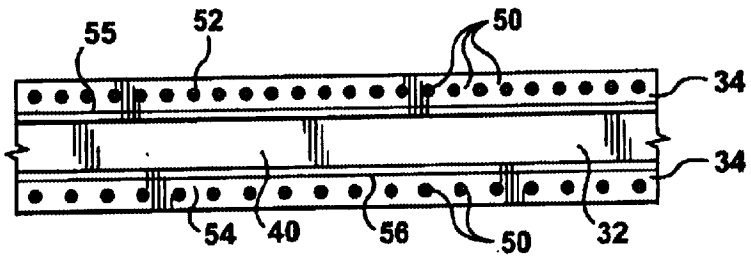
FIG. 6 is an elevation view of the inside of the hockey net protector shown in FIG. 2.
Figure 7:
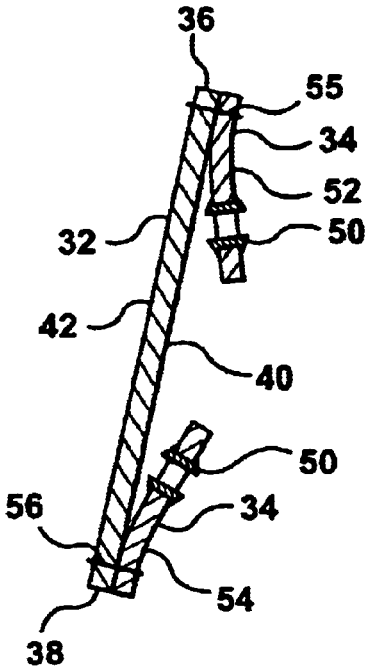
FIGS. 7, 8 and 9 are side sectional views showing alternative lines of attachment between portions of the inner layer and the outer layer.
Figure 8:
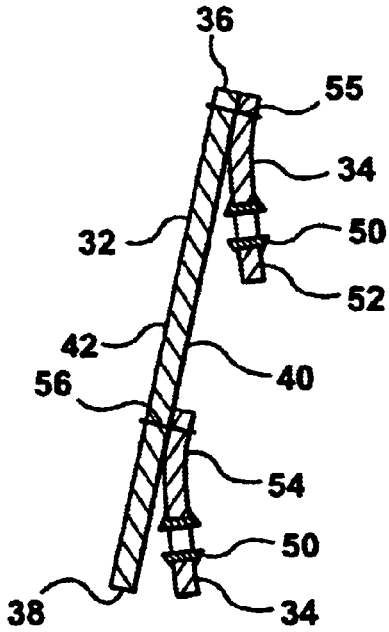
Figure 9:
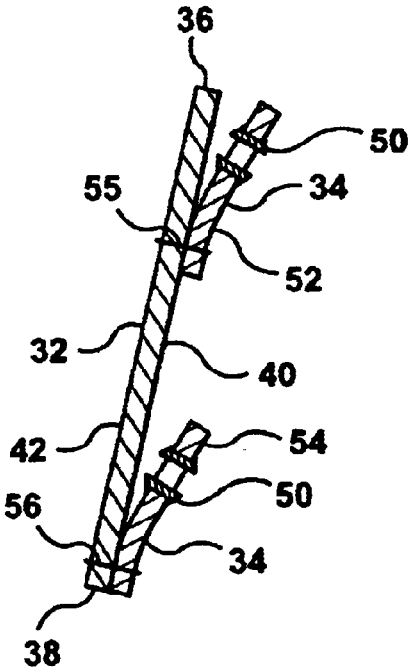

Referring to FIG. 6, the center-to-center spacing between adjacent grommets 50 on the lower grommet band 54 may be larger than that for the upper grommet band 52, because there is a reduced concern of the puck becoming lodged in a pocket between adjacent grommets 50 and the lower rear bar 24. The center-to-center spacing may be, for example, 3".

Referring to FIGS. 6, 7, 8 and 9, the lower grommet band 54 may be attached to the outer layer 32 similarly to the upper grommet band 52. The line of attachment of the lower grommet band 64 to the outer layer 32 is shown at 56. The line of attachment 56 may be spaced from the lower edge 38 of the outer layer 32 and the lower grommet band 54 may extend downwardly therefrom, and have a free lower edge, so that the remaining portion of the outer layer 32 that is below the line of attachment 56 can at least partially cover the lower rear bar 24 and the crimping 28. Alternatively, the line of attachment 56 may be along the lower edge of both the lower grommet band and the outer layer 32 so that the lower grommet band 54 extends upwardly therefrom and has a free upper edge (see FIGS. 7 and 9). Alternatively, the line of attachment 56 may be above and below the grommets 50.

Figure 10:
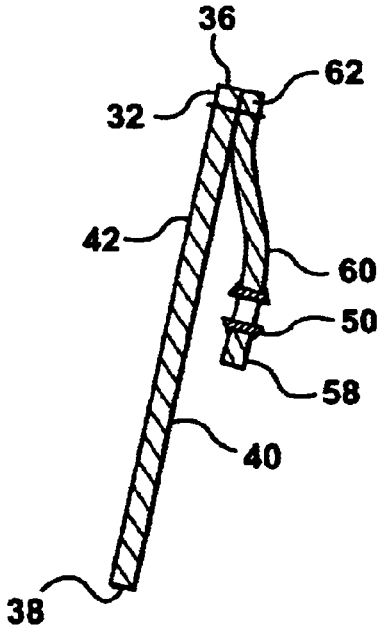
FIG. 10 is a side sectional view showing an alternative inner layer attached to the outer layer.

Reference is made to FIG. 10, which shows an alternative inner layer 58. Inner layer 58 comprises a single grommet band of material 60, having a plurality of grommets 50 thereon. The grommet band 60 may be made from a similar material to the grommet bands 52 and 64. The grommets 50 may be arranged in any suitable way, for example, in a single row, or in a plurality of rows. The inner layer 58 may be attached to the outer layer along a single line of attachment 62, which may, for example, be along the top of the band 60 so that the band 60 extends downwards therefrom. Alternatively, the inner layer 58 may be attached to the outer layer 32 along a plurality of lines of attachment, such as along the top and bottom edges of the band 60.

Figure 11:
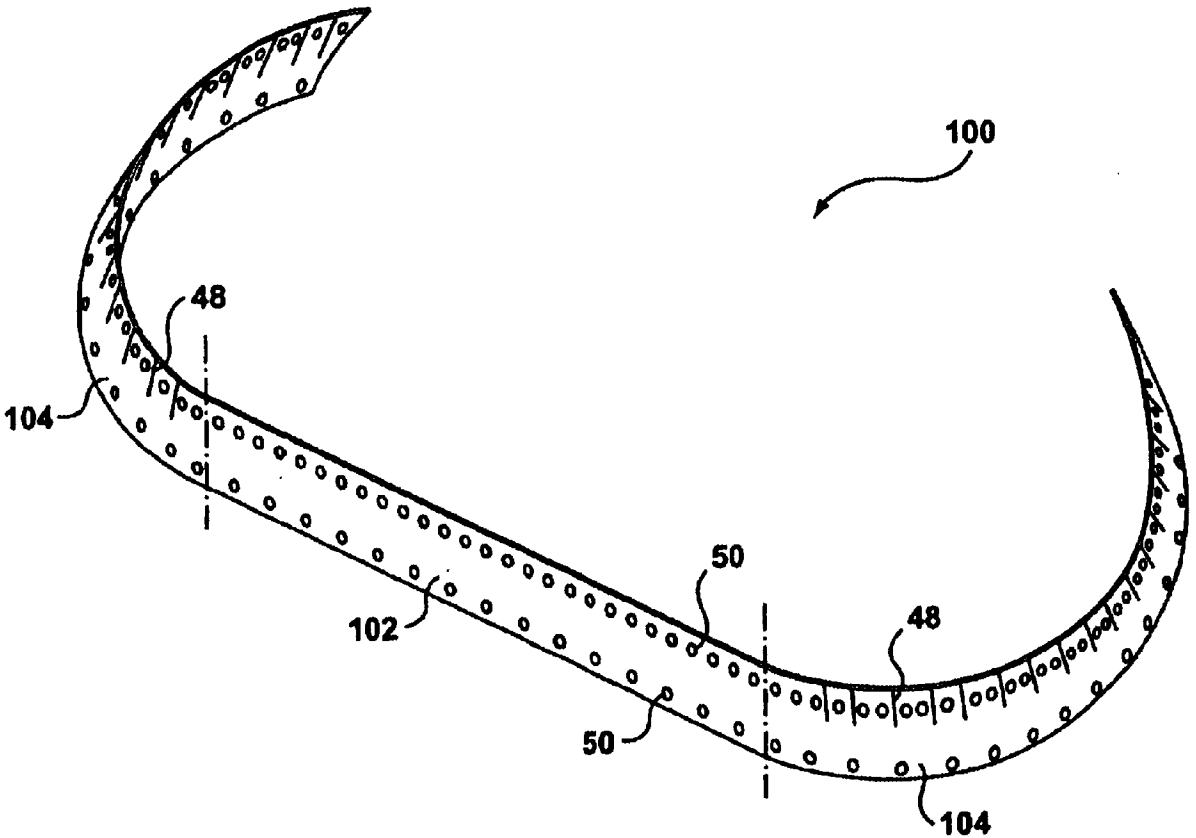
FIG. 11 is a perspective view of a hockey net protector in accordance with another embodiment of the present invention.

Reference is made to FIG. 11, which shows a hockey net protector 100 in accordance with an alternative embodiment of the present invention. Hockey net protector 100 includes a single layer that is similar to outer layer 32 and includes a planar central portion 102 and two outer portions 104 which have pleats 48 thereon so that the outer portions 104 are generally cone-shaped. The protector 100 has a plurality of grommets 50 mounted thereon. Grommets 50 may he arranged in any suitable way, such as, for example, in a single row, or in a plurality or rows, as shown.

Figure 12:
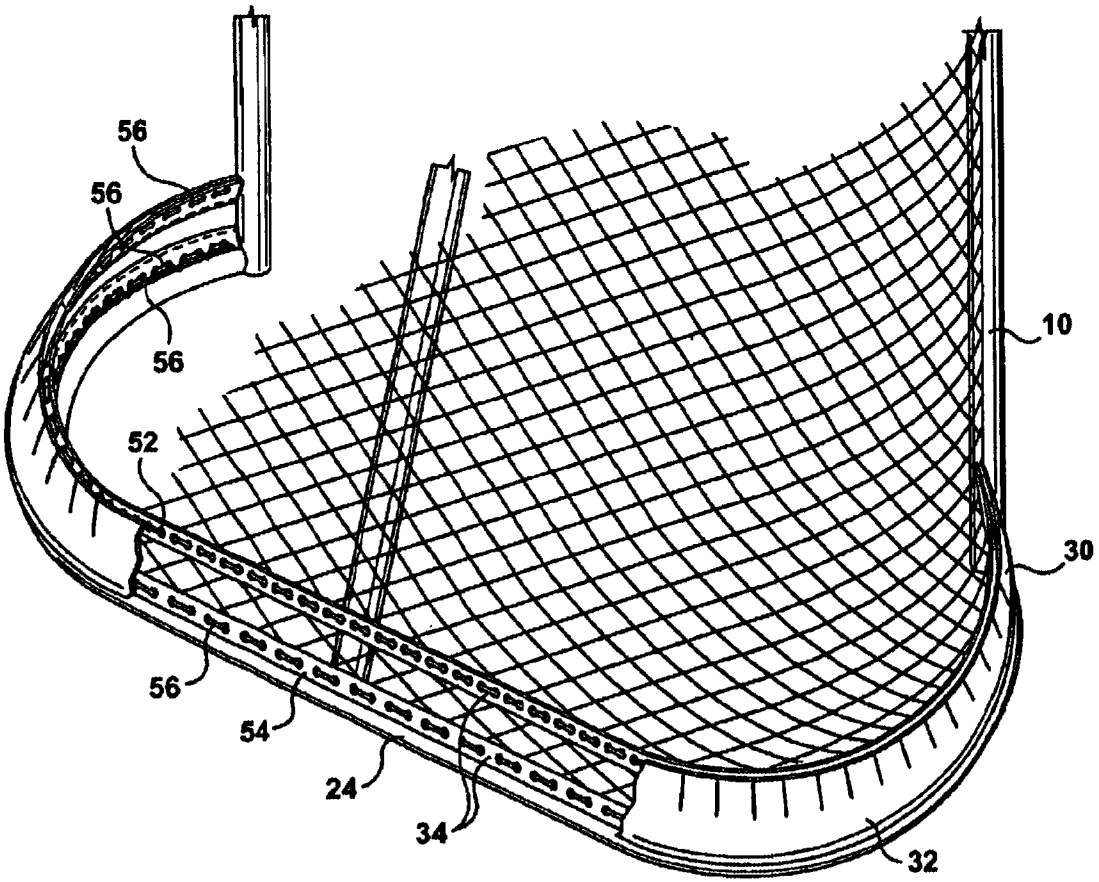
FIG. 12 is an enlarged perspective cut-away view of the hockey net protector shown in FIG. 2 attached to the hockey net shown in FIG. 1*a.*

As shown in FIG. 12, a cord 66, such as nylon cord can be used to attach the upper grommet band 52 to the mesh 14 on the hockey net 10. The cord 56 may be woven tightly through the grommets 50 and the mesh 14, to draw the upper portion of the hockey net protector 30 against the mesh 14. Similarly, a cord 56 may be used to attach the lower grommet band 54 to the crimping 26 on the lower rear bar 24. The cord 56 may be woven tightly through the grommets 50 and between the crimping 26 and the lower rear bar 24, to draw the lower portion of the hockey net protector against the lower rear bar 24.

Because the grommets 50 are positioned on the inner layer 34, and are covered by the outer layer 32, there is a reduced risk for the cords 56 to become entangled in a players skates during play behind the net 10. The conical shape of the outer portions 46 permits them to fit closely against the side portions 18 of the hockey net 10. The close fit reduces the risk of the outer portions 46 being caught by a player's skate during play behind the net 10. Furthermore, the close fit reduces the risk of a puck being caught between the protector 30 and the mesh 14 of the hockey net 10. The spacing of the lower grommet band 54 from the lower edge 38 at the outer layer, permits the outer layer to at least partially cover the lower rear bar 24, and thus protect against metal-to-metal contact between a player's skates and the lower rear bar 24.

Hockey net protector 10 may include any suitable number of grommet bands 52, 54, and may have any suitable number of rows or any other suitable arrangement of grommets 50 thereon.

While the above description constitutes the preferred embodiments, it will be appreciated that the present invention is susceptible to modification and change without departing from the fair meaning of the accompanying claims.

What is claimed is:

1. A hockey net protector for a hockey net having a lower rear bar, said lower bar having an upper side, said upper side having crimping thereon, the hockey net protector comprising:

an outer layer, said outer layer comprising an elongate band of tear resistant and puncture resistant material, said band having an inside face, an upper edge and a lower edge; and an inner layer, said inner layer having a plurality of grommets mounted thereon for connecting said protector to a hockey net, said inner layer being attached to said inside face of said outer layer, so that said grommets are covered by said outer layer, wherein said inner layer comprises an upper grommet band and a lower grommet band, said upper and lower grommet bands each having a row of said grommets thereon and being attached to said inside face of said outer layer along a line of attachment, and wherein said hockey net has a lower rear bar, said lower bar having an upper side, said upper side having crimping thereon.

and wherein said lower grommet band has an upper edge and said line of attachment for said lower grommet band is along said upper edge of said lower grommet band so that said lower grommet band extends downwardly therefrom and has a free lower edge, and said line of attachment is spaced from said lower edge of said outer layer, so that when said lower grommet band is connected to said crimping, said outer layer is adapted to cover said lower rear bar.

2. A hockey net protector as claimed in claim 1, wherein said grommets on said upper grommet band are spaced from each other by a distance that is less than the diameter of a hockey puck.

3. A hockey net protector as claimed in claim 1, wherein:

said hockey net has a sloped, generally planar central portion and a generally conical side portion on each side of and tangentially associated with said central portion, and said outer layer has a flat central portion for protecting said central rear portion of said hockey net, and said outer layer has two outer portions, each said outer portion having a generally coned shape, so that said outer portions are adapted for mating with said generally conical side portions.

4. A hockey net protector as claimed in claim 1, wherein:

said hockey net has a sloped, generally planar central portion and a generally conical side portion on each side of and tangentially associated with said central portion, and said outer layer has a planar central portion for protecting said central rear portion of said hockey net, and said outer layer has two outer portions, each said outer portion having transverse pleats extending from said upper edge down partially across the width of said band, so that said outer portions are adapted for mating with said generally conical side portions.

5. A hockey net protector, comprising:

an outer layer, said outer layer comprising an elongate band of tear resistant and puncture resistant material, said band having an inside face, an upper edge and a lower edge; and an inner layer, said inner layer having a plurality of grommets mounted thereon for connecting said protector to a hockey net, said inner layer being attached to said inside face of said outer layer, so that said grommets are covered by said outer layer.

wherein said inner layer comprises an upper grommet band and a lower grommet band, said upper and lower grommet bands each having a row of said grommets thereon and being attached to said inside face of said outer layer along a line of attachment, wherein said upper grommet band has a lower edge and said line of attachment for said upper grommet band is along said lower edge of said upper grommet band, so that said upper grommet band extends upwardly therefrom and has a free upper edge.

6. A hockey net protector as claimed in claim 5, wherein said grommets on said upper grommet band are spaced from each other by a distance that is less than the diameter of a hockey puck.

7. A hockey net protector as claimed in claim 5, wherein:

said hockey net has a sloped, generally planar central portion and a generally conical side portion on each side of and tangentially associated with said central portion, and said outer layer has a flat central portion far protecting said central rear portion of said hockey net, and said outer layer has two outer portions, each said outer portion having a generally coned shape, so that said outer portions are adapted for mating with said generally conical side portions.

8. A hockey net protector as claimed in claim 5, wherein:

said hockey net has a sloped, generally planar central portion and a generally conical side portion on each side of and tangentially associated with said central portion, and said outer layer has a planar central portion for protecting said central rear portion of said hockey net, and said outer layer has two outer portions, each said outer portion having transverse pleats extending from said upper edge down partially across the width of said band, so that said outer portions are adapted for mating with said generally conical side portions.

* * * * *